US010870147B2

(12) United States Patent
Ballant et al.

(10) Patent No.: US 10,870,147 B2
(45) Date of Patent: Dec. 22, 2020

(54) METHOD FOR KNOCKING OUT A FOUNDRY CORE AND METHOD FOR MANUFACTURING BY CASTING COMPRISING SUCH A METHOD

(71) Applicant: SAFRAN AIRCRAFT ENGINES, Paris (FR)

(72) Inventors: Didier Ballant, Moissy-Cramayel (FR); Patrick Fauvelliere, Moissy-Cramayel (FR); Vincent Kaleta, Moissy-Cramayel (FR); Yann Margutti, Moissy-Cramayel (FR); Jean-Paul Parlange, Moissy-Cramayel (FR)

(73) Assignee: SNECMA, Paris (FR)

( * ) Notice: Subject to any disclaimer, the term of this patent is extended or adjusted under 35 U.S.C. 154(b) by 331 days.

(21) Appl. No.: 15/576,674

(22) PCT Filed: May 19, 2016

(86) PCT No.: PCT/FR2016/051196
§ 371 (c)(1),
(2) Date: Nov. 22, 2017

(87) PCT Pub. No.: WO2016/193567
PCT Pub. Date: Dec. 8, 2016

(65) Prior Publication Data

US 2018/0133791 A1 May 17, 2018

(30) Foreign Application Priority Data

May 29, 2015 (FR) ..... 15 54911

(51) Int. Cl.
*B22D 29/00* (2006.01)
*B22C 9/04* (2006.01)
*B22C 9/10* (2006.01)

(52) U.S. Cl.
CPC ..... *B22D 29/002* (2013.01); *B22C 9/04* (2013.01); *B22C 9/10* (2013.01); *B22D 29/005* (2013.01)

(58) Field of Classification Search
CPC .... B22D 29/00; B22D 29/001; B22D 29/002; B22D 29/005; B22D 29/006; B22C 9/04;
(Continued)

(56) References Cited

U.S. PATENT DOCUMENTS 4,141,781 A * 2/1979 Greskovich ..... B22D 29/002 134/22.17
5,465,780 A * 11/1995 Muntner ..... B22C 9/04 164/516

(Continued)

FOREIGN PATENT DOCUMENTS

DE 10 2013 003 303 A1 8/2014
EP 1 710 029 A2 11/2006
RU 2 414 326 C1 3/2011

OTHER PUBLICATIONS

Written Opinion dated Sep. 9, 2016, for International Application No. PCT/FR2016/051196, filed May 19, 2016, 4 pages.

(Continued)

*Primary Examiner* — Kevin P Kerns
*Assistant Examiner* — Steven S Ha
(74) *Attorney, Agent, or Firm* — Christensen O'Connor Johnson Kindness PLLC

(57) ABSTRACT

A method for knocking out a foundry core confined in an internal cavity in a part at the end of a casting operation, in particular a lost-wax casting operation, includes at least a primary chemical knocking-out step. During the primary chemical knowing-out step, the part is subjected to a chemical solution to dissolve the core, in a sealed enclosure. The method further includes a secondary step of knocking out by ultrasounds in water or an aqueous solution contained in an (Continued)

ultrasound tank, during which the part is subjected to ultrasounds to loosen core residues from walls of the cavity.

9 Claims, 3 Drawing Sheets

(58) Field of Classification Search
CPC ..... B22C 9/10; B22C 9/101; B22C 9/103; B22C 9/108; B22C 9/18
See application file for complete search history.

(56) References Cited

U.S. PATENT DOCUMENTS

| | | | | |
|---|---|---|---|---|
| 7,935,295 | B2 | 5/2011 | McGourlay | |
| 2006/0219664 | A1 * | 10/2006 | McGourlay ..... | B22D 29/002 216/90 |
| 2015/0375419 | A1 | 12/2015 | Günther et al. | |

OTHER PUBLICATIONS

International Preliminary Report on Patentability dated Dec. 5, 2017, issued in corresponding International Application No. PCT/FR2016/051196, filed May 19, 2016, 1 page.
International Search Report dated Sep. 9, 2016, for International Application no. PCT/FR2016/051196, filed May 19, 2016, 5 pages.
Written Opinion dated Sep. 9, 2016, or International Application No. PCT/FR2016/051196, filed May 19, 2016, 4 pages.

* cited by examiner

METHOD FOR KNOCKING OUT A FOUNDRY CORE AND METHOD FOR MANUFACTURING BY CASTING COMPRISING SUCH A METHOD

The invention relates to a method for knocking out a foundry core and to a method for manufacturing by casting comprising such a knocking-out method.

Numerous parts used in the engineering industry are obtained by a casting process, and in particular by a lost-wax casting process. This is the case in particular for turbine engine blades, some of which comprise one or more internal cavities which are intended to permit, for example, the circulation of cooling air.

A turbine engine, as used for propulsion in the aeronautical field, comprises an atmospheric air inlet which communicates with one or more compressors that are rotated about the same axis. The primary flow of said air, after having been compressed, supplies a combustion chamber that is arranged annularly about said axis and is mixed with a fuel which is burned to supply hot gases, upstream, to one or more turbines through which the pressure of said gases is reduced, the turbine rotors driving the rotors of the compressors. The engines operate at the temperature of the gases at the turbine inlet, which temperature is as high as possible, as the performance of the turbine engine is dependent on said temperature. Accordingly, the materials of the hot portions are selected to resist said operating conditions and the walls of the parts swept by hot gases, such as the walls of distributors or of turbine blade wheels, are provided with cooling means, and in particular with internal cavities which are intended to allow a flow of cooling air to be channeled. In the case of movable turbine blades, in particular, said airflow comes from an internal portion of the rotor.

In a lost-wax casting process of this type of blade known from the prior art, lost-wax models are created that confine cores which are used when pouring the metal in order to create a cavity which will be used to cool the blade in the turbine engine. When the metal is poured, said metal replaces the volume previously occupied by the wax confining the core or cores. Said cores must then be removed when the metal has solidified in what is known as a 'knocking-out' operation.

According to a first design known from EP 1 710 029 A2, the cores are dissolved in a solvent liquid of which the agitation and temperature are controlled. This type of operation does not guarantee effective dissolution of the cores in the cavities.

According to a second design known from DE 10 2013 003303 A1, the cores are dissolved in an aqueous solution subjected to agitation means. This type of operation does not guarantee effective dissolution of the lost-wax cores.

According to a third design known from EP 1 710 029 A2, the cores are mounted on a rotating drum and dissolved in an alkaline solution subjected to agitation means, in particular by ultrasound. This type of operation does not guarantee good accessibility to the lost-wax cores by the alkaline solution.

According to a fourth known design, an autoclave enclosure is used for this purpose, which is subjected, in a known manner, to compressed air pressure of approximately 4 to 20 bars, and filled with a basic solution, generally a soda-based solution.

Depending on the appearance of the soda deposit remaining on the parts at the end of the knocking-out operation, the operator in charge of removing the cores may decide to inject water into the cavity or cavities at a pressure of between 70 and 130 bars. Said injection of water helps clean the internal surface of the part and contributes in theory to removing the ceramic residues remaining in the cavity, which are usually situated in what are known as cavity bottom areas, which are difficult to access, even for pressurised basic baths.

However, it has been observed in practice that, even with a knocking-out operation under a basic solution and an injection of pressurised water, residues made up of ceramic and basic solution may still remain at the bottom of the cavity previously occupied by the core.

Moreover, it is not possible to inject water at a higher pressure, as too high a pressure in the cavity or cavities might cause metallurgical defects which could subsequently prove harmful during later heat treatment of the blade.

Moreover, nor is it possible to repeat the autoclave knocking-out operation under a basic solution because, as well as the result of such an operation not being guaranteed and possibly proving ineffective, this type of operation lasts for a considerable time and the number of cycles of autoclave knocking out under a basic solution is therefore limited by procedures aimed at optimising the occupation and use of the autoclave enclosures.

The invention overcomes the drawbacks known from the prior art by proposing a novel way of knocking out cores that allows the residues remaining in particular at the bottom of the cavity to be removed in a simple, rapid and effective way.

Accordingly, the invention proposes a method for knocking out a foundry core confined in an internal cavity in a part at the end of a casting operation, in particular a lost-wax casting operation of the type described earlier, which comprises, in a known manner, at least a primary chemical knocking-out step during which the part is subjected to a chemical solution to dissolve the core, in a sealed enclosure.

According to the invention, said method comprises a secondary step of knocking out by ultrasounds during which the part is subjected to ultrasounds to loosen core residues from walls of the cavity.

According to other features of the invention:

during the secondary step, the part is immersed in water or an aqueous solution possibly comprising an additive and contained in an ultrasound tank, during the secondary step, the part is subjected to ultrasounds of which the direction of propagation is oriented in a general direction of orientation of the cavity, and/or transversely relative to said general direction of orientation of the cavity, during the secondary step, the ultrasounds are emitted at least by a transducer placed preferably at the bottom of the tank, such that the ultrasounds are emitted towards the surface of the water or of the aqueous solution contained in the tank, the method is suitable for knocking out at least one core from at least one generally elongate part oriented in a general direction and, during the secondary step, said at least one part is arranged in the ultrasound tank by orienting the general direction of orientation thereof in a vertical direction, during the secondary step, the temperature of the water or of the aqueous solution is between 10 and 60° C., and the ultrasounds are emitted at a frequency of 14 to 50 kHz and at a power of 500 to 1300 W, for a period of 10 to 100 minutes, during the primary knocking-out step, the part is arranged in an autoclave enclosure subjected to a compressed air pressure of 4 to 20 bars and containing a basic solution, during the primary knocking-out step, at the end of the treatment of the part in the basic solution, the cavity in the part is subjected to an injection of water at a pressure of 70 to 130 bars.

The invention also relates more generally to a method for manufacturing, by lost-wax casting, a foundry part comprising at least one internal cavity opening onto one of the surfaces thereof.

Said method is characterised in that it comprises at least:

a step of manufacturing a core made of a ceramic material, intended to form at least one cavity in the finished part, a step of manufacturing a lost-wax model during which a model of the part is produced by injecting wax into a press and during which the core is included in said model, a step of assembling in a cluster a plurality of models produced by repeating the second step, a step of manufacturing a ceramic mould or shell and of placing the cluster of models in said mould, a step of pouring the metal into the mould or shell, a cooling step, a step of knocking out of the ceramic shell, and the steps of the knocking-out method according to any of the preceding claims, the method possibly comprising a supplementary step of finishing, in particular by high-speed machining, and of non-destructive testing of the part.

The invention also relates to a facility for implementing the above-mentioned knocking-out method. Said facility comprises:

a first tank or autoclave, containing a solution, preferably a basic solution, for chemically dissolving a foundry core, and a second ultrasound bath tank, containing water or an aqueous solution possibly comprising an additive, the second tank being provided with at least one transducer.

The invention will be better understood and other details, features and advantages of the present invention will become clearer on reading the description that follows given by way of non-limiting example and with reference to the accompanying drawings in which.

In the description that follows, identical reference signs designate parts that are identical or that have similar functions.

Figure 1A:
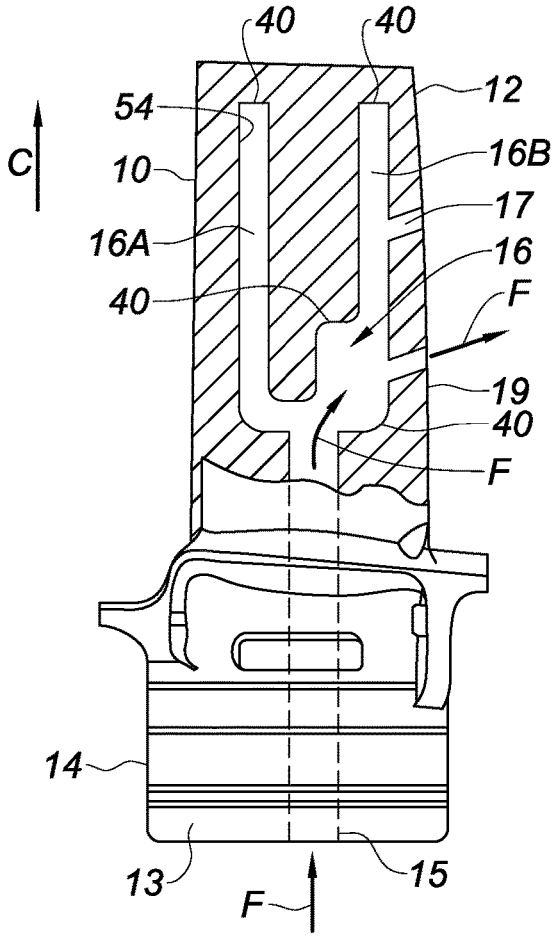
FIGS. 1A and 1B are schematic side views in which the turbine engine blades obtained by a lost-wax casting manufacturing method are partly stripped away.
Figure 1B:
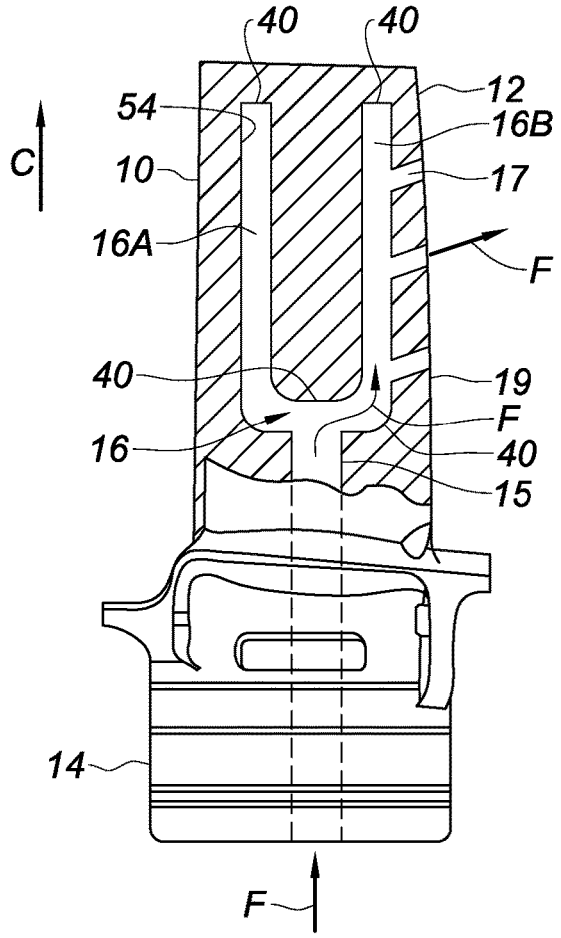

FIG. 2 to 6 show a method for manufacturing, by lost-wax casting, a foundry part, in particular a turbine engine blade 10 of the type shown in FIG. 1A or 1B.

In a known manner, such a turbine engine blade 10 essentially comprises a vane 12 and a root 14 rigidly connected to the vane 12, the blade being intended to be received in a rotor disk (not shown) to form a compressor wheel or turbine wheel of a turbine engine, in particular an aeronautical engine.

In the particular case of a blade 10 intended to form a turbine blade, each blade 10 generally comprises at least one internal cavity 16 having a main general direction C which is intended to allow the circulation of an airflow F inside the blade 10.

The internal cavity 16 may take different forms. In FIG. 1A, a blade 10 has been shown comprising a cavity having two substantially parallel branches 16A and 16B, branch 16B being wider than branch 16A. In FIG. 1B, a blade 10 has been shown comprising a cavity having two substantially parallel, and substantially identical, branches 16A and 16B. It will be understood that the shape of the cavity 16 does not limit the invention.

The blade 10 may also comprise a plurality of cavities, but also ducts intended to take the airflow F into the cavity 16, and to remove said air therefrom.

Accordingly, as shown in a non-limiting manner in relation to the invention, in FIGS. 1A and 1B, for example, the blade 10 may comprise a supply duct 15 which opens out at the base 13 of the root thereof 14, which communicates with the cavity 16, and by which the cavity 16 is supplied with a flow F of pressurised cooling air coming from an internal portion of the rotor of the turbine engine.

Accordingly, the blade 10 may also comprises venting ducts 17, which communicate with the cavity 16, and which open at a trailing edge 19 of the blade 10, by which the flow of cooling air F is vented from the cavity 16.

The number of ducts 15 and 17 is also not limiting in relation to the invention.

Thus, the internal cavity 16 opens at one of the surfaces or portions of the blade 10, that is, either at the trailing edge 19 of the blade 10 by means of the venting ducts 17, or at a lower surface 13 of the root thereof 14 by means of the supply duct 15.

It will be noted that, in a variant of the blade 10 types described with reference to FIGS. 1A and 1B, the blade 10 could comprise a cavity, known as a trough, opening at the upper end thereof opposite the lower surface 13 of the root 14, and communicating with the internal cavity thereof by means of outlet openings.

The circulation of an airflow F inside the cavity 16 in the blade 10 allows the blade 10 to be cooled during operation, and is particularly advantageously in the case of turbine blades 10 which are particularly subjected to gases at high temperatures coming from the combustion chamber of the turbine engine, and for which cooling is necessary in order to prevent the deterioration thereof.

Figure 2:
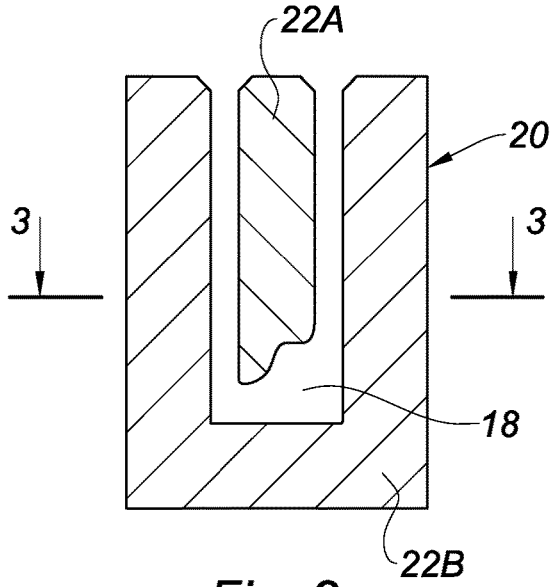
FIG. 2 is a schematic view showing a first step of a lost-wax casting manufacturing method, in particular a first step of manufacturing a core made of a ceramic material, intended to form at least one cavity in a turbine engine blade.

Such a blade 10 is obtained by a lost-wax casting process, a first step of which, shown in FIG. 2, consists of manufacturing at least one core 18. FIG. 2 shows the manufacture of a core 18, having a shape that is complementary to the cavity 16 to be obtained, in order to form said cavity 16 during casting of the blade 10.

As shown in FIG. 2, the core 18 is usually made of a ceramic material, and may, by way of example and in a way that does not limit the invention, be cast in a mould 20 so as to have two portions 22A, 22B which form complementary impressions of the shapes of the core 18 to be obtained.

Once solidified, the core 18 is removed from the mould 20. It is then assembled with other cores intended to form the ducts 15 and 17 mentioned previously.

It will be understood that the shape of the core 18 which has been shown in FIG. 2 does not limit the invention, and that in particular the core 18 could comprise shapes intended to form the ducts 15 and 17 in a single piece, so as to use only one core for casting the blade 10.

Figure 3:
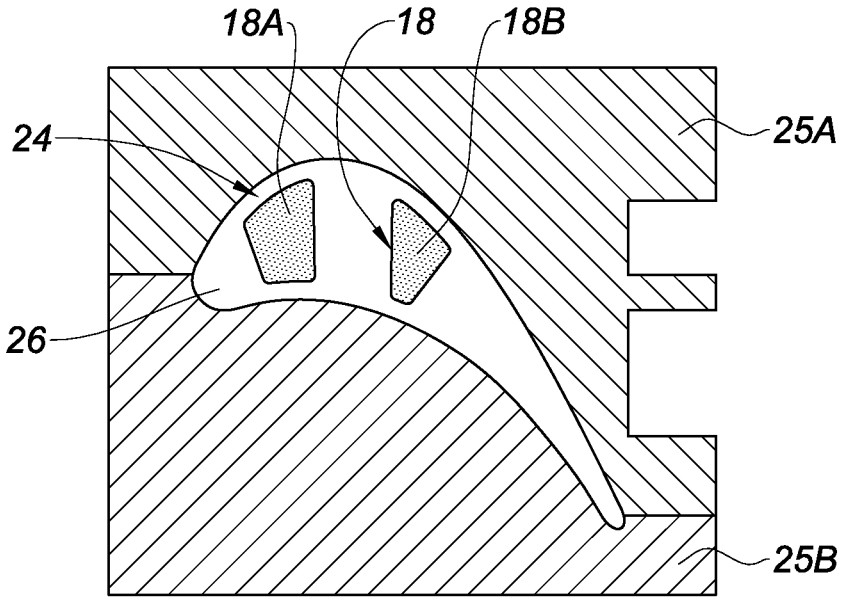
FIG. 3 is a schematic view in cross section through the plane 3-3 of FIG. 2, showing a second step of the method, in particular a second step of manufacturing a lost-wax model of a turbine engine blade including the core.

Next, during a second manufacturing step of the blade 10, as shown in FIG. 3, a model 24 of the blade 10 is produced by injecting wax into a press in which the core 18 mentioned above was previously arranged.

As can be seen in FIG. 3, the core 18 comprises two branches 18A, 18B, complementary to the branches 16A, 16B of the cavity 16 to be obtained in the blade 10.

During said second manufacturing step, the core 18 described above is arranged in a mould 25 comprising a lower 25A and an upper 25B portion, as are complementary cores of the cavities forming the ducts 15 and 17 of the blade 10, which have not been shown in the sectional plane of FIG. 3.

Depending on the support offered by the portions 25A and 25B of the mould 25, the core may be supported between the two portions 25A and 25B of the mould directly or by means of pins which have not been shown. The wax 26 is then injected into the mould 25 in order to coat the core 18.

After opening the lower and upper portions of the mould 25, a wax model 24 that includes the core 18 is thus obtained.

Figure 4:
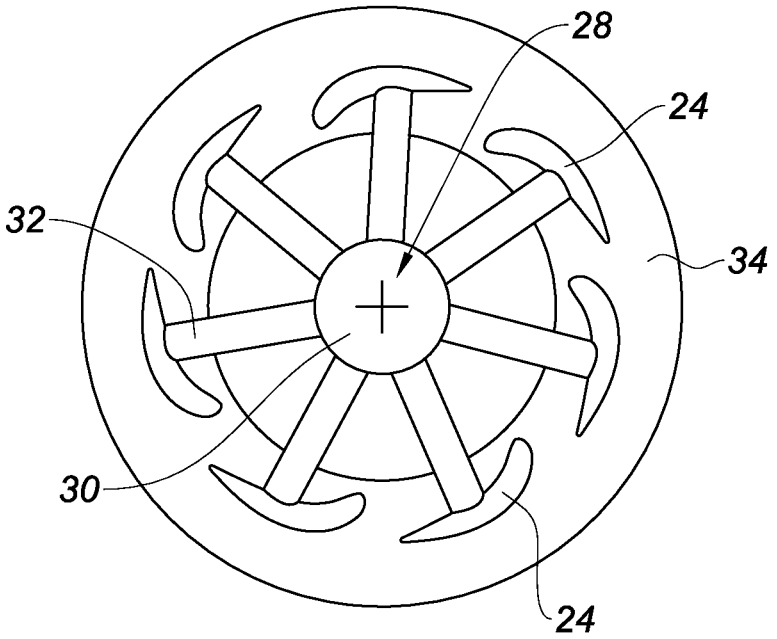
FIG. 4 is a schematic view showing a fourth step of the method, in particular a fourth step of manufacturing a ceramic mould and of placing a previously assembled cluster of models in said mould.

Next, during the third assembly step, a plurality of identical models 24 obtained in the same way as at the second step of FIG. 3 is assembled as a cluster 28, as shown in FIG. 4.

The cluster 28, shown in FIG. 4, essentially comprises a central stem of wax 30 and branches 32 also of wax which radiate from the central stem 30 and which are each connected to at least one model 24 of the type previously described. The stem 30 and the branches 32 are intended to form cavities which allow, after de-waxing and when pouring the metal, channeling of the molten metal into said cavities.

Next, during a fourth manufacturing step of the method shown in FIG. 4, a ceramic mould 34 or shell intended to receive the cluster 28 of models 24 is produced.

Preferably, the ceramic mould 34 or shell is cast around the cluster 28 in such a way that the wax cluster 28 is completely confined in the ceramic material of the mould 34. The ceramic shell 34 is the result of the ceramic coating, which consists of depositing a succession of ceramic layers on the wax cluster 28 or shaft.

Next, during a fifth step, the ceramic mould 34 or shell is de-waxed, that is, after removal of the wax or de-waxing, cavities are obtained inside the shell that correspond to a negative volume of the wax cluster 28 or shaft.

Next, during a sixth step (not shown) the metal is poured into the mould 34. The molten metal runs into the mould running successively into the cavities previously occupied by the wax stem 30, branches 32, and models 24 of the shaft, the molten metal thus occupying the volume released by the de-waxing.

At the end of said operation, the metal has therefore completely occupied the volume of the models 24 initially made of wax and said metal confines the cores 18 of the models 24.

During a seventh cooling step (not shown), the assembly of the mould 34 containing the cluster 28 is left to cool until complete solidification of the casting metal.

Next, during an eighth step of knocking out of the ceramic shell, the ceramic mould 34 or shell around the cluster 28 is destroyed. Said destruction may be mechanical and/or chemical.

The result obtained is a cluster of moulded blades 10 which are then separated from each other to undergo finishing operations.

In particular, the blades 10 must undergo a knocking-out process aimed at removing the last residues of the ceramic mould 34 and the core 18 for each of said blades 10.

The removal of the residues of the ceramic mould 34 does not pose any particular difficulties. The mould 34 is arranged so as to be in contact with the outer surfaces of the blades 10, and therefore the majority of the mould 10 is removed in one operation when said mould is destroyed around the cluster 28. The small amounts of residue of the mould 34 that may remain in contact with the blades 10 can be removed during the same operations that will be described with reference to the knocking-out method that is the subject matter of the invention.

Figure 5:
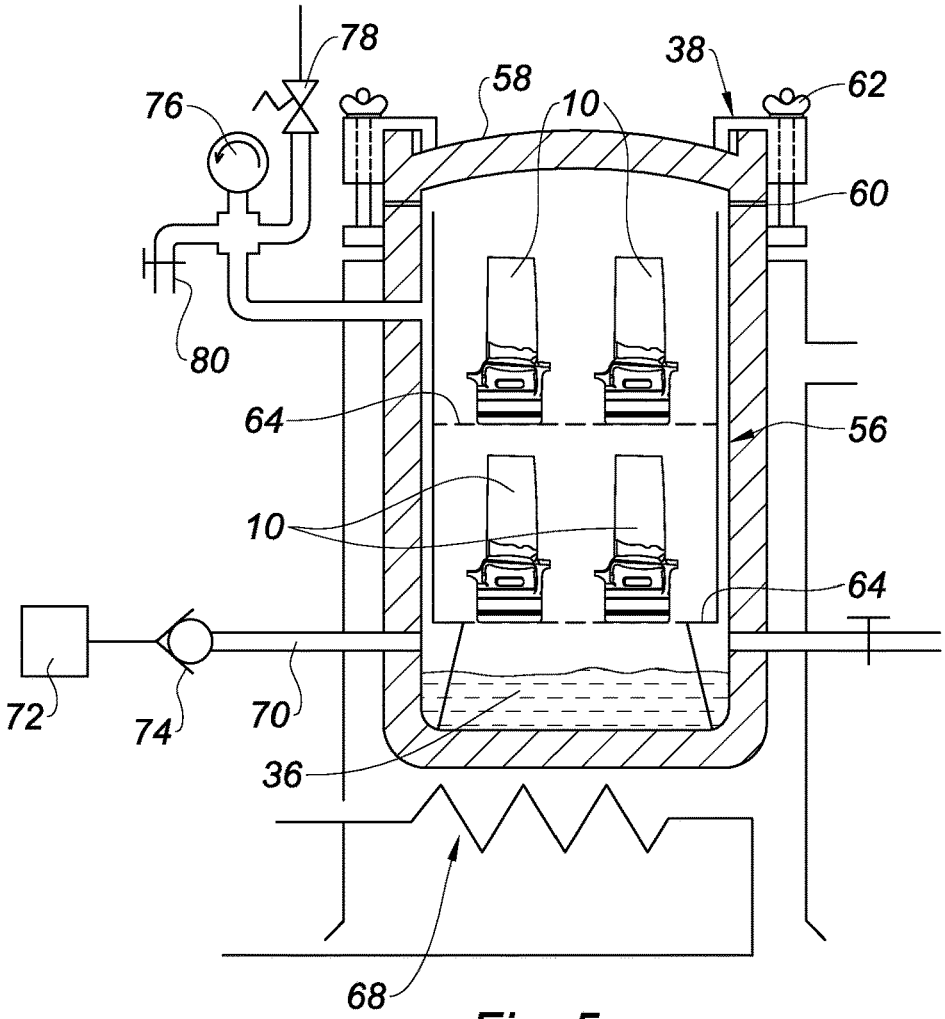
FIG. 5 is a schematic view showing a primary step of the knocking-out method according to the invention.

In a known manner, a conventional method for knocking out a foundry core 18 confined in an internal cavity 16 in a blade 10 at the end of a casting operation as described above comprises at least a primary chemical knocking-out step, as shown in FIG. 5, during which the blade 10 is subjected to a chemical solution 36 allowing the core 18 to be dissolved in a sealed enclosure 38.

Conventionally, an autoclave-type sealed enclosure 38 is used to do this.

In FIG. 5, four blades 10 have been shown schematically in the course of treatment in a vertical autoclave enclosure 38. Said configuration is of course not limiting, and in the course of said primary knocking-out step, a larger number of blades may be treated, just as a vertical autoclave enclosure 38 having a greater capacity may also be used.

Moreover, it will be understood that the technical features of the autoclave enclosure 38 which is described in the rest of the present description are in this case purely illustrative and do not limit the autoclave enclosures that could be implemented as part of the method that is the subject matter of the invention.

The autoclave enclosure 38 essentially comprises a tank 56 which is closed and sealed by a lid 58, the seal being provided by a joint 60 which is placed between the tank 56 and the lid 58. The lid is attached to the tank 56 by rocking wing nuts 62 which allow the lid to resist the pressures that prevail inside the tank 56.

Inside the tank 56 baskets 64 are arranged on which the blades 10 to be treated are positioned.

A basic solution 36, in particular a soda solution, is placed at the bottom of the tank 56, which is heated by a heating means 68, for example one or more electric resistors.

Moreover, the tank 56 is subjected to compressed air at a pressure of approximately 4 to 20 bars which is supplied by a pipe 70 opening into the tank 56, said pipe 70 being connected to a source 72 of compressed air by a non-return valve 74.

Finally, the autoclave enclosure 38 comprises a pressure gauge 76 allowing the pressure in the tank 56 to be checked, as well as a safety valve 78 and a bleed line 80.

During the primary knocking-out step, the tank 56 of the autoclave enclosure 38 is heated so as to evaporate the basic solution 36, which works its way under pressure into the cavities of the blades 10 and causes the cores to dissolve.

This type of primary knocking-out step is generally not sufficient to ensure complete knocking out of the core 18.

It has been observed that residues of the core 18 usually remain in the cavity 16 in each blade 10, amalgamated with traces of chemical solution 36, particularly in bottom or corner areas 40 of the cavity 16 in the blade 10, as shown in FIGS. 1A and 1B. In FIGS. 1A and 1B, the bottom or corner areas 40 in which residues of the core 18 remain are shown by way of non-limiting, indicative example of the invention, the arrangement thereof depending on the internal shapes of the cavity 16.

To remove said residues, the internal cavity 16 of the blade 10 is subjected to an injection of water at high pressure, for example approximately 70 to 130 bars.

The primary knocking-out step therefore comprises said water-injection step, which occurs after the blades 10 have passed into the autoclave enclosure 38.

Said water injection theoretically allows the inner surface of the cavity 16 in the blade 10 to be cleaned and the majority of the ceramic residues remaining in the cavity 16 to be removed.

However, it has been observed that even with the aid of this type of water-injection operation, ceramic residues and basic solution residues mixed together may remain in the bottom or corner areas 40 of the cavity 16, due to the difficulty of the pressurised water accessing said bottom or corner areas 40.

However, it is not possible to increase the water-injection pressure inside the blade 10 as there is a risk of deforming said blade 10 and/or of changing the mechanical features thereof, which would make said blade unsuitable for subsequent heat treatment intended to ensure the resistance thereof to the high temperature of the gases within the turbine engine for which said blade is designed.

Neither is it possible to repeat the operation of chemically knocking out the core 18, owing to manufacturing procedures aimed at optimising the use of the autoclave enclosures 38.

The invention overcomes this drawback by proposing a knocking-out method comprising a novel knocking-out step that helps ensure complete removal of the residues of the core 18.

Figure 6:
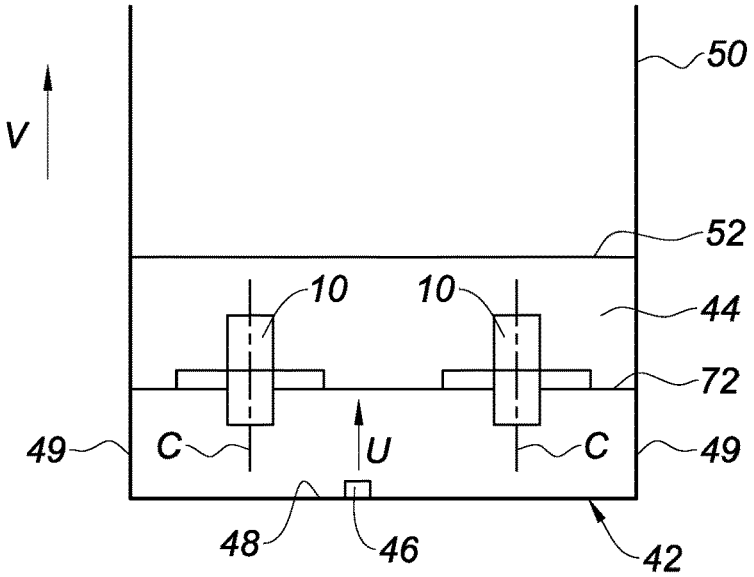
FIG. 6 is a schematic view showing a secondary step of the knocking-out method according to the invention.

Accordingly, as shown in FIG. 6, the method according to the invention comprises a secondary step of knocking out by ultrasounds, during which the blade 10 is subjected to ultrasounds to loosen the residues of the core 18 from the walls of the cavity 16.

Ultrasounds are already used in other processes, in particular in high-speed machining processes in order to clean the parts. Ultrasounds allow the chips resulting from high-speed machining, which are mixed with lubricant, to be subjected to vibrations which help loosen said chips.

Numerous other processes use ultrasound cleaning, more particularly for cleaning mechanical parts.

The invention advantageously proposes applying the use of ultrasounds, until now reserved for loosening chips, to loosening the residues of the ceramic material of the core that are amalgamated in a basic solution and adhere to the internal walls of the blades 10, by subjecting said residues to vibrations, propagated by ultrasound waves, which allow said residues to be loosened.

The facility for implementing the method according to the invention comprises a second ultrasound bath tank 42 containing a basket or support 72 intended to receive the blades 10 removed from the autoclave enclosure 38 described previously. The ultrasound bath tank 42 contains water or an aqueous solution 44, possibly comprising an additive which aids the dissolution of the cores, and said tank is provided with at least one transducer 46 suitable for generating ultrasounds inside the tank 42.

During the secondary knocking-out step, the blade 10 is completely immersed in the water or aqueous solution 44 contained in the ultrasound tank 42.

The arrow U shows the direction of propagation of the ultrasounds inside the tank 42. Preferably, the blade 10 is subjected to ultrasounds oriented in a direction U parallel to a general direction C of orientation of the cavity 16, or transversely relative to said general direction C of orientation of the cavity.

Indeed it is desirable for the ultrasounds not to be reflected randomly by vertical walls 54 of the cavity 16, as said walls have been illustrated in FIGS. 1A and 1B, so as not to be disturbed by the reflection or interference of the sound waves on said vertical walls. Reflection of the ultrasound waves on the vertical walls 54 at one angle or another would risk promoting the propagation of ultrasounds in different directions due to successive reflections, and consequently could possibly be a source of interference that would disturb the action of the ultrasounds.

This configuration is obtained if the direction U of propagation of the ultrasounds is oriented in parallel with the vertical walls 54 of the internal cavity 16 or transversely relative to said walls.

In FIG. 6, two blades 10 have been shown resting vertically on the basket 72, the cavities of which (not shown) have general orientations C which are parallel to the direction U of propagation of the ultrasounds.

Moreover, to encourage the propagation of ultrasounds inside the tank 42, the transducer 46 is, preferably, placed at the bottom and at a lower end 48 of the tank 42 so that the ultrasounds are emitted towards the upper end 50 of the tank 42, that is, towards the surface 52 of the water or of the aqueous solution 44.

Thus, the direction U of ultrasound propagation is substantially parallel to the vertical direction V. This configuration advantageously helps limit the influence of the reflection of ultrasounds emitted by the transducer 46 against side walls 49 of the tank 42. As this type of reflection is inevitable, the power of the sound waves reflected by each side wall 49 is reduced relative to that of the waves emitted by the transducer 46. This is due on the one hand, to absorption by the side wall 49 in question of the tank 42, and on the other hand to interference with the waves reflected by the other walls of the tank, and in particular by the opposite side wall 49.

It is advantageous for the ultrasounds emitted by the transducer 46 to be emitted in a direction U parallel to the side walls 49 so that said ultrasounds penetrate into the cavity in the blade 10 without being reflected by the walls 49 of the tank 46, that is, in a direction U parallel to the vertical direction V. However, this configuration does not limit the invention.

Thus, in the case of a turbine engine blade 10 which has a generally elongate shape and for which the cavity 16 also has a generally elongate shape, an optimal configuration may be proposed for the implementation of the secondary step, in which the blade 10 is preferably arranged in the tank 42 by orienting the general direction thereof, and thus the general direction of the cavity 16, in the vertical direction V, corresponding to the direction U of ultrasound emission, the transducer 46 being oriented such that the ultrasounds are emitted towards the surface 52 of the water or of the aqueous solution 44.

According to the invention, but in a non-limiting manner, tests have shown that the optimum results are obtained for a temperature of the water or of the aqueous solution 44 of between 10 and 60° C., the ultrasounds emitted by the transducer 46 being emitted preferably at a frequency of 14 to 50 kHz and at a power of 500 to 1300 W for between 10 and 100 minutes. The ultrasound tanks used in the finishing workshop have frequency characteristics of approximately 28 kHz at a power of approximately 900 W.

It will, of course, be understood that said secondary step may take place immediately after a primary knocking-out step under a basic solution, or under a primary knocking-out step under a basic solution with the addition of a pressurised water injection, as described above.

In the vast majority of cases, the secondary step allows complete knocking out of the part 10 to be achieved without damaging the material of said part. Said secondary step is very easy to implement, and may therefore be applied on an industrial scale to the treatment of the parts 10 using the method. Moreover, said necessary step does not require costly investment. The method according to the invention is therefore economically very advantageous.

Finally, advantageously, the manufacturing method according to the invention may comprise a supplementary finishing step carried out for example at a high-speed machining centre, said step comprising non-destructive testing of the blade 10.

The invention therefore proposes a particularly advantageous method of knocking out a cavity 16 in a turbine engine blade 10, and more generally, a method of manufacturing a turbine engine blade 10 which allows rapid knocking out of the lost-wax ceramic foundry cores 18 and which does not require prolonged occupation of the autoclave enclosures 38 used for knocking out by the same batch of blades 10, and which does not present risks that the blades 10 may be deformed.

The invention claimed is:

1. A method for knocking out a foundry core confined in an internal cavity in a part at the end of a casting operation, comprising at least a primary chemical knocking-out step during which the part is subjected to a chemical solution to dissolve the core, in a sealed enclosure or autoclave, the method further comprising a secondary step of knocking out by ultrasounds during which the part is immersed and subjected to ultrasounds in water or an aqueous solution contained in an ultrasound tank to loosen core residues from walls of the cavity.

2. The knocking-out method according to claim 1, wherein, during the secondary step, the part is subjected to ultrasounds of which the direction of propagation is oriented in a general direction (C) of orientation of the cavity, and/or transversely relative to said general direction (C) of orientation of the cavity.

3. The knocking-out method according to claim 1, wherein, during the secondary step, the ultrasounds are emitted at least by a transducer placed at the bottom of the tank, such that the ultrasounds are emitted towards the surface of the water or of the aqueous solution.

4. The knocking-out method according to claim 1, wherein the method is suitable for knocking out at least one core from at least one generally elongate part orientated in a general direction and in that, during the secondary step, said at least one part is arranged in the ultrasound tank by orienting the general direction of orientation thereof in a vertical direction (V).

5. The knocking-out method according to claim 1, wherein, during the secondary step, the temperature of the solution is between 10 and 60° C., and the ultrasounds are emitted at a frequency of 14 to 50 kHz and at a power of 500 to 1300 W, for a period of 10 to 100 minutes.

6. The knocking-out method according to claim 1, wherein, during the primary knocking-out step, the part is arranged in an autoclave enclosure subjected to a compressed air pressure of 4 to 20 bars and containing a basic solution.

7. The knocking-out method according to claim 6, wherein, during the primary knocking-out step, at the end of the treatment of the part in the basic solution, the cavity in the part is subjected to an injection of water at a pressure of 70 to 130 bars.

8. A method for manufacturing, by lost-wax casting, a foundry part comprising at least one internal cavity opening onto one of the surfaces thereof the method comprising:

a step of manufacturing a core made of a ceramic material, intended to form at least one cavity in the finished part, a step of manufacturing a lost-wax model during which a model of the part is produced by injecting wax into a press and during which the core is included in said model, a step of assembling in a cluster a plurality of models produced by repeating the step of manufacturing a lost-wax model, a step of manufacturing a ceramic mould or shell and of placing the cluster of models in said mould, a step of pouring the metal into the mould, a cooling step, a step of knocking out of the shell, and the steps of the knocking-out method according claim 1.

9. The method of claim 8, further comprising the step of finishing and of non-destructive testing of the part.

* * * * *